US008609973B2

(12) United States Patent
D'Amours

(10) Patent No.: US 8,609,973 B2
(45) Date of Patent: Dec. 17, 2013

(54) AUDIO EFFECTS CONTROLLER FOR MUSICIANS

(75) Inventor: John Robert D'Amours, Phoenix, AZ (US)

(73) Assignee: CleanStage LLC, Chandler, AZ (US)

( * ) Notice: Subject to any disclaimer, the term of this patent is extended or adjusted under 35 U.S.C. 154(b) by 0 days.

(21) Appl. No.: 13/297,266

(22) Filed: Nov. 16, 2011

(65) Prior Publication Data

US 2013/0118340 A1 May 16, 2013

(51) Int. Cl.
*G10H 1/32* (2006.01)
*G10H 3/00* (2006.01)

(52) U.S. Cl.
USPC ..... 84/746; 84/626; 84/662; 84/737

(58) Field of Classification Search
None
See application file for complete search history.

(56) References Cited

U.S. PATENT DOCUMENTS

| | | | | |
|---|---|---|---|---|
| 4,481,854 | A | 11/1984 | Dugas | |
| 4,630,520 | A * | 12/1986 | Bonanno | 84/655 |
| 4,702,141 | A * | 10/1987 | Bonanno | 84/626 |
| 4,852,443 | A * | 8/1989 | Duncan et al. | 84/733 |
| 5,105,711 | A | 4/1992 | Barnard | |
| 5,147,969 | A | 9/1992 | Hiyoshi et al. | |
| 5,245,128 | A | 9/1993 | Araiza | |
| 5,323,650 | A | 6/1994 | Fullen et al. | |
| 5,471,405 | A | 11/1995 | Marsh | |
| 5,475,214 | A | 12/1995 | DeFranco et al. | |
| 5,576,507 | A | 11/1996 | LaMarra | |
| 5,714,706 | A | 2/1998 | Nakada et al. | |
| 5,765,300 | A | 6/1998 | Kianka | |
| 5,864,083 | A | 1/1999 | Caren | |
| 5,945,911 | A | 8/1999 | Healy et al. | |
| 6,410,835 | B2 * | 6/2002 | Suzuki et al. | 84/464 R |
| 6,441,294 | B1 | 8/2002 | Seli | |
| 6,570,078 | B2 | 5/2003 | Ludwig | |
| 6,838,610 | B2 * | 1/2005 | de Moraes | 84/730 |
| 6,861,582 | B2 | 3/2005 | Street | |
| 7,169,998 | B2 | 1/2007 | Kondo et al. | |
| 7,186,270 | B2 | 3/2007 | Elkins | |
| 7,191,644 | B2 | 3/2007 | Haselhurst et al. | |
| 7,339,107 | B2 | 3/2008 | Remignanti | |
| 7,426,873 | B1 | 9/2008 | Kholwadwala et al. | |
| 7,528,318 | B2 | 5/2009 | Nishitani et al. | |
| 7,541,536 | B2 | 6/2009 | Daniel | |
| 7,569,762 | B2 * | 8/2009 | Baum et al. | 84/626 |
| 7,587,937 | B2 | 9/2009 | Haselhurst et al. | |
| 7,667,129 | B2 | 2/2010 | Chidlaw et al. | |
| 7,771,320 | B2 | 8/2010 | Riley et al. | |
| 7,908,774 | B2 | 3/2011 | Mirza et al. | |
| 2003/0196542 | A1 | 10/2003 | Harrison, Jr. | |
| 2004/0044804 | A1 | 3/2004 | MacFarlane et al. | |
| 2005/0056142 | A1 * | 3/2005 | Mapleston et al. | 84/645 |
| 2006/0278068 | A1 | 12/2006 | Nielsen et al. | |
| 2007/0000374 | A1 * | 1/2007 | Clark et al. | 84/724 |
| 2007/0169615 | A1 * | 7/2007 | Chidlaw et al. | 84/723 |
| 2007/0182545 | A1 | 8/2007 | Baum et al. | |

(Continued)

*Primary Examiner* — Marlon Fletcher

(57) ABSTRACT

This invention introduces several methods, apparatus, and systems for controlling musician audio effects or musical instruments wirelessly from the performer's footwear. In one embodiment, the performer's foot motions are monitored using a motion detection device and compared against a set of criteria by a microprocessor to activate or deactivate one or more audio effects that are ready or "armed." Once the foot controller is activated, a radio transmits sampled foot pressure that is used by the Base Unit to modulate all armed audio effects capable of being modulated. Tactile feedback is provided in the footwear as a means to confirm system status changes.

19 Claims, 14 Drawing Sheets

(56) References Cited

U.S. PATENT DOCUMENTS

| | | | | |
|---|---|---|---|---|
| 2007/0234880 | A1* | 10/2007 | Adams et al. | 84/601 |
| 2007/0240560 | A1* | 10/2007 | Plamondon | 84/744 |
| 2007/0245886 | A1* | 10/2007 | Adams et al. | 84/745 |
| 2008/0258921 | A1 | 10/2008 | Woo et al. | |
| 2008/0318679 | A1 | 12/2008 | Tran et al. | |
| 2010/0063779 | A1 | 3/2010 | Schrock et al. | |
| 2010/0115799 | A1* | 5/2010 | Welter et al. | 36/137 |
| 2011/0045907 | A1 | 2/2011 | Villa et al. | |

* cited by examiner

AUDIO EFFECTS CONTROLLER FOR MUSICIANS

Priority filing of U.S. Provisional Patent No. 61/413,683 filed Nov. 15, 2010 is claimed. Said provisional patent application is hereby incorporated by reference in its entirety into the present disclosure.

BACKGROUND

For today's experienced musician, an expression pedal such as a wah-wah, volume, (or others that use a rocking type mechanism controlled by the foot), are as common as the music from the 60's where many of these effects were born. Conventional use of the foot or feet by any member of the musician family of artists, in addition to the population of pedal or pad type users (in various industries, activities, games or sports) is well defined. For the musician population, this includes operation of variable electronic controls such as an expression-type pedal used by guitarists, physical type pedals used by percussionists, sustain or organ pedals used by keyboardists, and so on. Other existing uses of the feet include control of one or more pedals activated by on/off switches typically found in a guitarist's pedal board.

These conventional pedals are quite simple to operate between songs, however, for many musicians and especially new users, it can be difficult to coordinate these foot motions while playing an instrument such as an electric guitar due to cognitive overload, especially during complex solos, and most difficult when using a rocking type expression pedal. Instead, the use of foot pressure as the control method has shown to be more natural as an expression of the music rhythm, and can be modulated simply by bending the knees, shifting weight, or stomping the foot. This feature alone opens the pedal market for this invention to the more novice musicians, and offers the user improved balance over a pedal that is fixed in one location. Furthermore, the control profile from pressure of a stomping foot can ramp up and down through the range of control very quickly, which is a motion nearly impossible to duplicate through the use of a conventional expression pedal. This fast attack capability creates the control technique that can be compared to the fast profile of an auto-wah, but now with the ability to control gradually on demand and the motion becomes a part of the performance. As with most music industry pedals, this approach separates the pedal control function from playing the guitar, unlike several recent inventions that integrate the control function with the hands or movement of the guitar only to further complicate operation. These hand-mounted audio effect controllers create conditions where effect modulation interferes with finger picking or strumming. So it is one object of this invention that it is easier to modulate audio effects for both the experienced musician and new users alike over any other existing system.

Another key object of this invention is to provide a method that allows users the freedom of movement about the stage. Conventional musician pedal effects require the performer to stand in one location on stage. Some musicians, for example, Kirk from the band Metallica, use several expression pedals located at different locations on stage for creating the same wah-wah effect offering him different stage positions to engage with the audience. Alternatively, to obtain more freedom of movement, the foot controller in this invention uses a motion sensing device, such as an accelerometer, to monitor foot movement patterns as the method of activating or deactivating audio effects. Because it is critical to ensure this accurate on/off control, foot movement pattern recognition may include use of the foot pressure sensor as well as the ability for the user to select from a set of desired foot movement patterns or even create their own. As there are potentially hundreds of foot movement patterns possible, several specific patterns are disclosed that focus on similarity to conventional controls that allow for ease of learning, ability to distinguish patterns to prevent false triggers, and ease of use by taking advantage of natural body movements. And when using this embodiment to simulate conventional stomp switch audio effects, this same freedom of movement about the stage makes it even easier than a stomp switch because the performer need not look for the pedal. Simply tap the toe of the foot, for example, and the pre-armed pedals are toggled. And for keyboardists who kick the classic sustain pedal out of proper position, this invention again solves this problem so the musician can ignore it and focus on the keyboard or audience. Simply assign or map the controller to any one or more of these MIDI channels or parameters. It's the pedal that goes wherever you go.

During the active state, the foot controller monitors foot pressure and a radio transmits this data to a Base Unit for variable modulation of one or more audio effects either internal to the Base Unit or externally to other audio effects. This way, commands can operated across more than one audio effect and the foot controller can be used to either modulate or activate/deactivate the armed effect or multiple armed effects simultaneously as desired by the user.

A tactile element of this invention, such as a vibration motor, provides user feedback regarding the activation or deactivation process. When combined with pressure modulation control, and made a part of the footwear, there is no longer a need to look for the pedal during a performance thereby allowing the musician to focus more on the instrument or audience.

Many musicians use more than one type of expression pedal, so having one pedal to control all audio effects reduces the overall equipment and setup time needed for a performance. And because the pedal is part of a shoe or insole, then any type of pedal board enclosure would be capable of housing the Base Unit where some expression pedals won't fit. For the professional musician, for example Slash's performance during the 2010 Super Bowl where all the effects were off-stage except his one expression pedal, for the first time they could enjoy a stage that is free from any effects hardware completely.

Even new audio effects can be made available to the live performer, instead of relying on conventional sound crew for mixing. For example, a wide stance of the feet combined with a side to side weight shifting of the performer makes for a natural panning control method that would normally be difficult to synchronize by a second person; again this new control method is based on foot pressure.

In another embodiment, a wireless relay transceiver provides additional range for the performer, and further simplifies the musician's overall setup because it combines conventional wireless instruments with the foot controller using a single Base Unit, whereas, a wireless audio effects controller and a wireless instrument would normally require two Base Units, one for each. This integrated approach has the benefit of reducing power requirements for the foot controller, extends the RF range, and reduces the overall cost for the musician as compared to two systems.

This invention also includes a unique set of criteria for defining new uses for this foot controller invention, including examples where these criteria apply. In the music industry, the original idea was born. On a wider scale, unique criteria for determining the language of foot motion becomes an even more powerful application of this concept in fields such as gaming, manufacturing, medical, sports, or any industry.

SUMMARY OF THE INVENTION

The main control element in this invention uses a sensor ( ) capable of sensing variable pressure and is controlled by changes in foot pressure. The sensed pressure is used to wirelessly control one or more parameters of virtually any audio effect. Various locations of this sensor are disclosed, including within the footwear of various styles, in or attached to a removable insole, or even externally attached through quick or more permanent means.

The accelerometer ( ) element monitors foot movement patterns and is analyzed by a microprocessor to provide Master On/Off control. Pressure sensor data in the analysis can help in distinguishing intended control from natural foot movements such as foot tapping, walking, jumping and so on, or to cancel the Master On/Off control command.

The pressure sensing device such as a Force-Sensing Resistor (FSR) or other type pressure sensors, together with the accelerometer are monitored by a microprocessor device in a manner such that foot pressure corresponds to a measurable change in pressure that is read by the microprocessor ( ). This pressure sensor is periodically and frequently sampled by the microprocessor, and the sampled values are transmitted wirelessly, in real-time, to a remote Base Unit for decoding and control of the audio effect, instrument, or MIDI command. Signal conditioning and analysis may be performed either prior to RF transmission in the foot controller or after RF transmission occurs in the Base Unit, or both, for efficiency reasons. Additional functions of the Base Unit that allow for flexibility of use cases will be described, including capability to also send data back to the foot controller for internet updates, modal configuration settings, wake-up signals, user alerts, and so on.

Monitoring the pressure sensing device in this way will result in a smooth reading of pressure change to simulate pedal angle, pedal pressure, parameter knob rotation, or to act as a selection switch related to audio effects or instruments through foot motions disclosed. However, there are undesirable characteristics of an FSR and other sensor types and enclosures, as well as variability from one musician to another (such as the fit of the footwear, user weight, or user habits), that may require calibration to be described in further detail.

The Base Unit is located remotely with all the other effect boxes, integrated with a multi-effects controller, or in systems such as a musician rack. One of the main functions of the Base Unit is to decode the radio transmission to produce a voltage or digital value that corresponds to foot pressure. This signal is then used to either control a digital potentiometer or other voltage or current control type circuit for the desired control of the audio effect. The digital potentiometer offers other options such as to electrically replace worn out potentiometers in older but highly valued pedals.

In another embodiment, the pressure control signal is also used to adjust parameters on external effect boxes either through the use of an external control voltage signal or digital signal, and may include a wireless network between the foot controller and pedals together with their associated parameters. The external audio effect boxes would also have a footswitch or foot sensing device such as capacitive sensor to detect applied surface pressure, and an indicator light for status of the applied control or for status of an armed or disarmed state. Arming means that the desired control parameter of any audio effect is capable of being controlled by a master On/Off control signal generated by user's foot movement pattern. This approach allows for control of multiple effects either independently or simultaneously from one control master signal, and could further be configured for secondary arming capability to modulate a second or any one of a set of audio effect parameters within any audio effects box.

For a more integrated embodiment that makes use of other wireless needs for many musician or vocalists, the foot controller wirelessly communicates with a wireless repeater or Relay Body Pack worn by the performer, which relays this information wirelessly in addition to the audio signals generated by the musician. This embodiment thereby reduces the total number of wireless receivers for both systems from two to one, plus it has the advantage in that the foot controller requires less RF power due to its close proximity to the Relay Body Pack, and is not subjected to as much signal loss due to what would be normally seen without using the Relay Body Pack (as in the case of the performer walking behind objects on stage). The audio effect could also be integrated into the Relay Body Pack so that the resulting audio signal is already modulated before being sent Base Unit, and the Relay Body Pack could manage foot signal conditioning, where power is more abundant than what is practical in the foot controller.

Short vibrations within the shoe from a vibrating motor ( ) provides user feedback for either confirmation of a user control action or to help distinguish user foot commands through independent foot movements of a multi-stage control pattern.

A different embodiment uses the same controller electronics for control of virtual hand-held instruments such as a maraca, tambourine, triangle, cowbell, drums, or any instrument normally used by the hand or hands. The foot embodiment could also be used to operate hand instruments or modulation, and likewise, the hand embodiment could be employed to control foot or feet type instruments or modulation. In the hand-held version the purpose of the sensors would be interchanged so that the pressure sensor would be used to activate or deactivate the audio effect while the accelerometer would be used as the source to convert hand motion to shaker type instrument control. The electronics module within the foot controller could also be made to also fit into the shaker assembly for a dual purpose device.

Finally, the insole embodiment can be mirrored for a left shoe versus the right shoe ( ). In this assembly, a matching blank soul (with limited or no electronics) would be provided so that the left and right shoes would have the same feel. There is optionally a dual soul embodiment that utilizes both left and right foot controllers either independently for separate control use cases or in unison for combining left and right foot motion and pressure data to offer a wider range of control capability over a single sole system.

DETAILED DESCRIPTION

Figure 1:
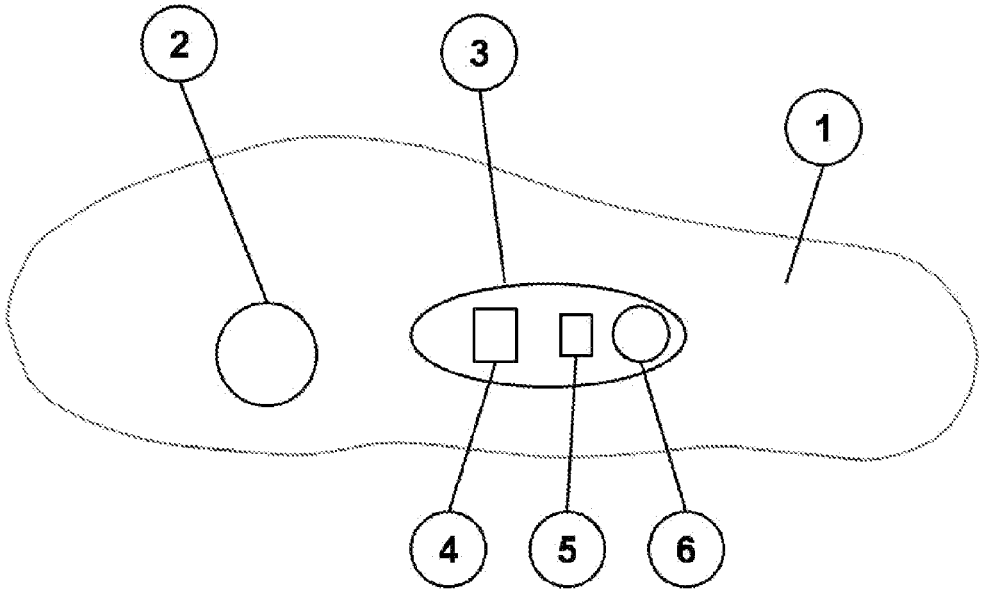
FIG. 1 shows the area of footwear, either as part of the footwear or as an insole assembly that is self-contained and fits into a musician's shoe, together with the foot controller electronics.

FIG. 1 shows Pressure Sensor (2) which senses foot pressure and is used by a musician to create a variable control signal for modulating audio effects while playing an electronic instrument such as a guitar, drums, a wearable keyboard, or even microphone amplified sources such as voice, harmonica, acoustic guitar, or any microphone amplified acoustic instrument.

Figure 2:
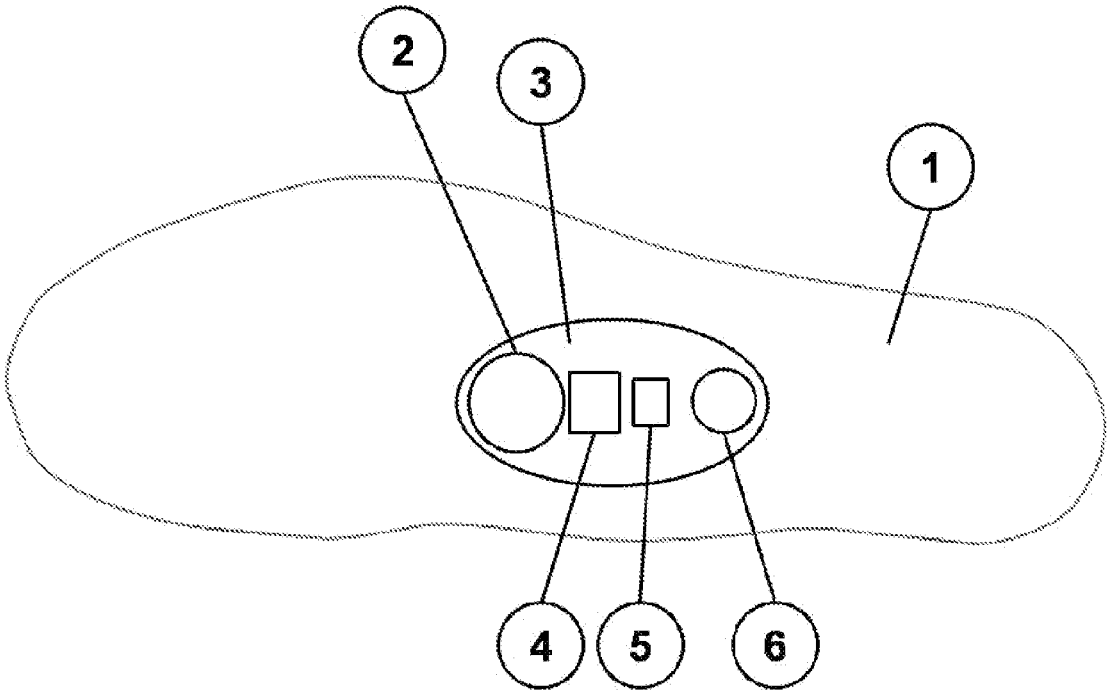
FIG. 2 is similar to FIG. 1 showing an alternate embodiment of the electronics as a self contained module.

Sole (1) of FIGS. 1 and 2 describe the general area under the feet and represent either the sole of the footwear, an insole, or the shoe bottom.

In FIG. 1, the main embodiment employs an FSR (2) (Force Sensing Resistor) and there are many types beyond the standard carbon-ink based products. In the prototype, a 100 lb range FSR was used, however, a 25 lb rating might offer more sensitivity depending on overall construction affecting the applied force at the sensor. FSR sensors typically require a few grams of force to start any change in resistance. Because of the protective cover and distribution of the user's weight over the entire sole, a solid backing helps to minimize other variables affecting the force applied to that particular area. Because FRS's can be damaged by shear forces, it may be advantageous to restrict movement side to side through the use of a protective layer of rigid material above and below the sensor, or other means to manage this shear force. FSRs can also degrade in their characteristics through moisture, and if the assembly is not hermetic, then measures such as a Gore-Tex patch over the FSR vent may be necessary. Venting an FSR also suggests a relief cavity adjacent to its vent that allows pressurized air in the sensor to evacuate or intake air in order to prevent premature stresses on the sensor membranes.

Considering other methods of sensing pressure, an electro-mechanical approach may be advantageous. For example, in another embodiment, a resistive gel could suspend a conductive material and change resistance with pressure. As the gel is depressed, its height is changed offering a shorter path for electrons to flow through the medium thereby reducing electrical resistance. This method also offers added comfort for the user. A more rigid but flexible material such as rubber could offer the same properties, and would interface with the electronics using a array of contacts normally used in conventional FSRs. Additional electro-mechanical sensor designs may be suitable due to the low accuracy needed for foot modulation, however other novel methods do not negate the key claim regarding use of a sensor to measure foot pressure for said purpose of control.

In other embodiments, dual pressure sensors could also be employed to monitor the differential pressure between the heel and the toes as an alternate method of control, or could be used to provide more variety of control. For example, a pressure sensor toward the heel could modulate one audio effect or instrument, while a second sensor toward the ball of the foot or toe area could control another. In some circumstances, the pressure sensor toward the heel offers an easier method of providing a control signal such as rhythm, however, the preferred embodiment positions the sensor toward the ball of the foot, or any area of the foot capable of measuring foot pressure when pressure is applied on the ball of the foot and may include the arch area or any location within the footwear that corresponds to foot pressure. As an alternative in another embodiment, with the pressure sensor positioned to detect heel pressure, a reverse function acts as the equivalent to applied pressure forward of the heel. For example, when pressure is applied to the ball of the foot, the heel will experience a loss in pressure and vice versa, assuming there is no additional shift in weight between the left and right feet. This heel location has some advantages over areas toward the front of the shoe because the footwear can be made more rigid and therefore the sensor connection is potentially more reliable.

FIG. 2 shows another embodiment where the entire module is contained and placed in the center of the footwear or insole (3) and containing microprocessor (4), accelerometer (5), and the battery source. Since this is intended as a wireless controller, the RF Radio can be either a component or, in newer designs, as a part of a System on Chip combined with microprocessor (3).

Figure 3:
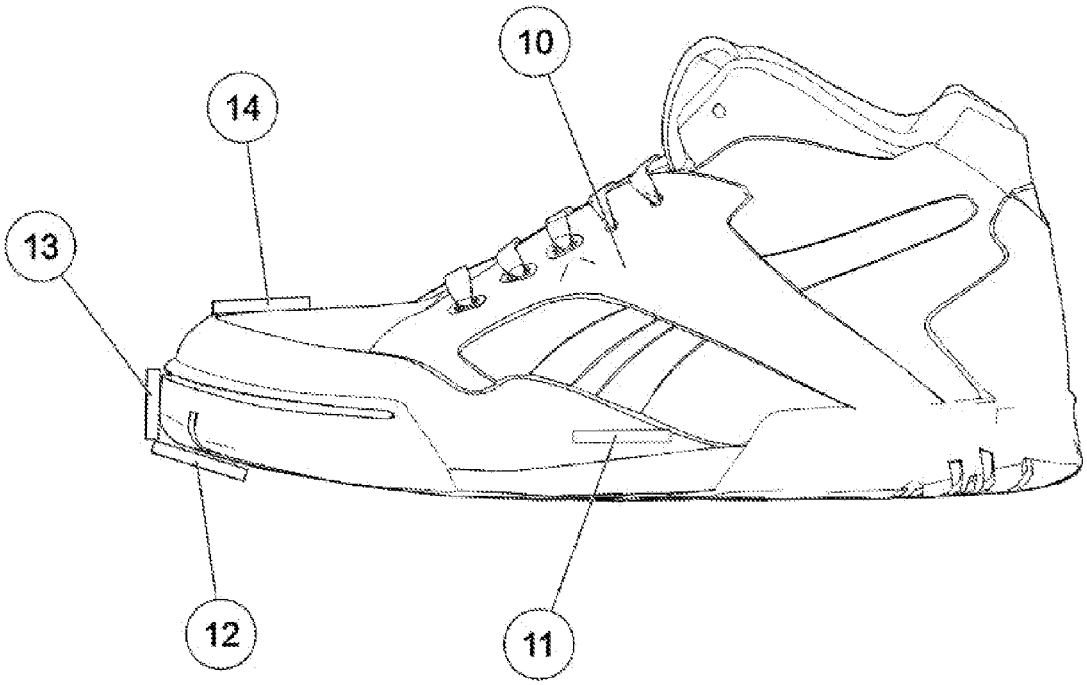
FIG. 3 shows various methods to integrate the foot controller into a shoe design, either internally or externally.

FIG. 3 shows other embodiments for combining the footwear electronics (11) of this invention with the adapted footwear (10). An external, attachable method places the pressure sensor (12) under the toe of the shoe (or further back under the ball of the foot), while the main electronics are contained in module (13). Display, LED, or indicator panel (14) is used for visual status of the controller and could be made as an integral part of the shoe or connected to module (13) as a shoe covering.

Use of pressure sensing for modulation of audio effects by itself would likely require the user to enable or disable the audio effect, and the most basic method would be to use existing methods such as an external footswitch or through coordination of a stage crew member. Since the audio effect would clearly benefit from On/Off control at any time and from any location on stage during a song or performance, then it only offers the advantage of using the natural bouncing (bending at the knees) or weight shifting from one foot to the other as the control method as compared to conventional pedals used today by musicians. Even in this basic configuration, it has been shown to be easier to control for the beginner, however, this solution would require constant RF transmission when turned on, thereby demanding more power consumption, as opposed to using RF transmission only when modulation control is needed.

An alternate embodiment would employ one or more external pressure control devices, or a wired sensing pad on the ground. However, this system by itself requires the user to be near the musician's pedal board unless the On/Off control is performed by a separate person, or if the on/off switch device and pressure sensor were made fully mobile for the performer.

One basic embodiment uses an additional pressure sensor or a mechanical switch contained within module 13 of FIG. 3, positioned on a portion of the footwear such as the tip of the shoe as shown, or beside the ball of the foot, and externally mounted to the footwear through any one of common means for permanent or temporary attachment. This provides the user with both mobility and ease of access because the pedal moves with the user, and does add the advantage of being easily accessed or used for a wide variety of shoes.

For the more covert embodiment, the On/Off control technology could be concealed within the footwear. For example, a Flex resistor sensor and a Pressure sensor could be used in combination. The On/Off control would be effectively toggled when the musician raises the heel with the ball of the foot on the ground (causing a Flex resistor change) with foot pressure applied for a brief period to the pressure sensor. This combined motion is meant to simulate the user pressing a more conventional foot switch and therefore might be easier to learn or use. However, this only provides one method for user control, and lab tests show that user foot movement signatures or user habits introduce the potential for false triggers.

For the more casual performer, a barefoot version is introduced that attaches with straps or other securing type devices to secure the controller to the bottom of the foot. For musicians wearing sandals, a relief slot or side tabs of this device aids in a secure alignment with the sandal. High variation in footwear clearly suggests the need for a modular approach to the electronics that can be mounted within the various footwear styles or into various insole sizes or custom designs.

The goal of the On/Off control method is to use simple, easy to learn, but unique movements that are similar in motion as what is normally used to operate today's standard footswitches or pedals. However, better ergonomic or natural motions could improve the user interface experience. Therefore a more versatile method that provides the desired mobility of the user eliminates the Flex sensor and employs an accelerometer (5) or any device capable of measuring acceleration, orientation, or movement, and used in combination with the pressure sensing device (2).

Figure 4:
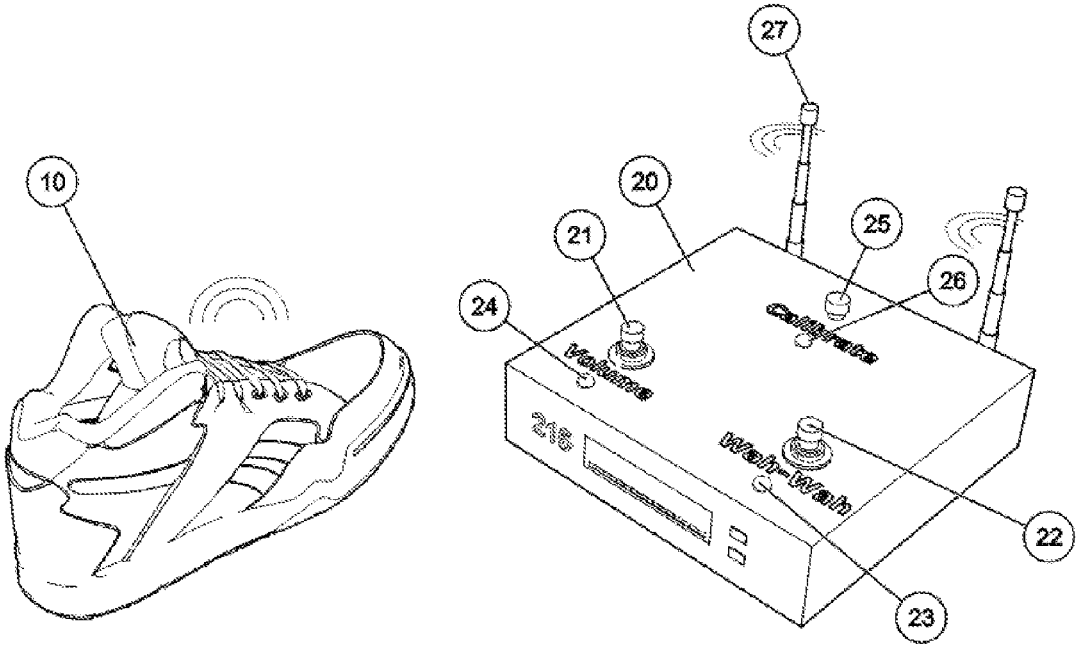
FIG. 4 shows the foot controller with radio communication to a Base Unit receiver.

FIG. 4 shows the footwear that contains the foot controller of FIG. 1, as well as the Base Unit (20). While in the "On" or active state, the foot controller's radio transmitter sends pressure control information to a receiver Base Unit (20) in real-time, received by Antenna (27). The Base Unit (20) also contains the Volume and Wah-Wah effects that are enabled or disabled respectively by toggle switches (21) and (22), and their Control On/off or "armed" state is indicated by LEDs (23) and (24). (Note that in a different embodiment, these two audio effects could be employed as a separate box or boxes and controlled by the Base Unit through a "Control Out" signal as described later in this document. However, the main embodiment combines them as one unit because these audio effects are normally controlled by a variable foot pedal.) LEDs (23) and (24) are bi-colored red and green. In the off state the associated LED for that effect is off and a reed relay (53) within the Base Unit (20) electrically bypasses any audio from the volume or wah-wah circuitry which is referred to as "True Bypass", although this is not essential and can be performed through buffers. From the off state, when the toggle switches (21) or (22) are depressed, the associated LED turns red to indicate it is armed and ready to turn on the audio effect. Finally, when the control signal from the foot controller goes active, the associated LED turns green. Since these two toggle switches serve to control Volume and Wah-Wah independently, it is possible to control both simultaneously to create a third audio effect not typically employed on most conventional Wah-wah pedals.

Figure 10:
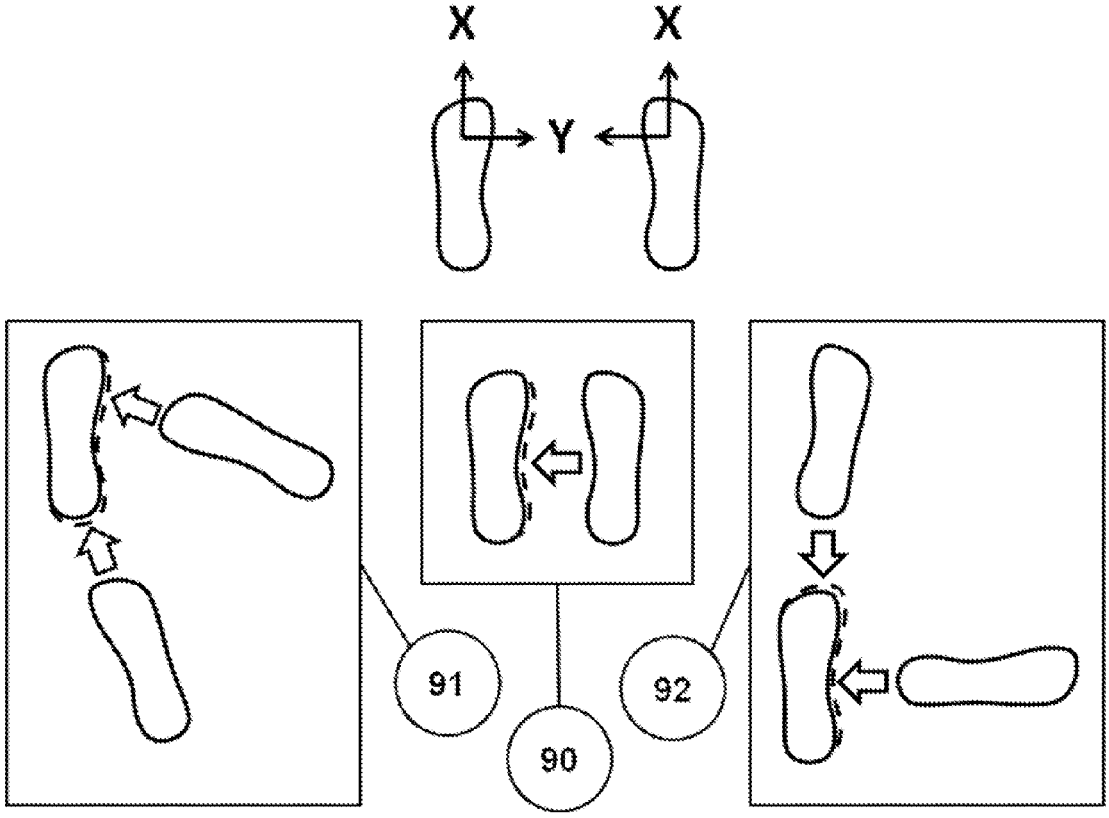
FIG. 10 is a top view describing various On/Off control foot patterns.
Figure 11:
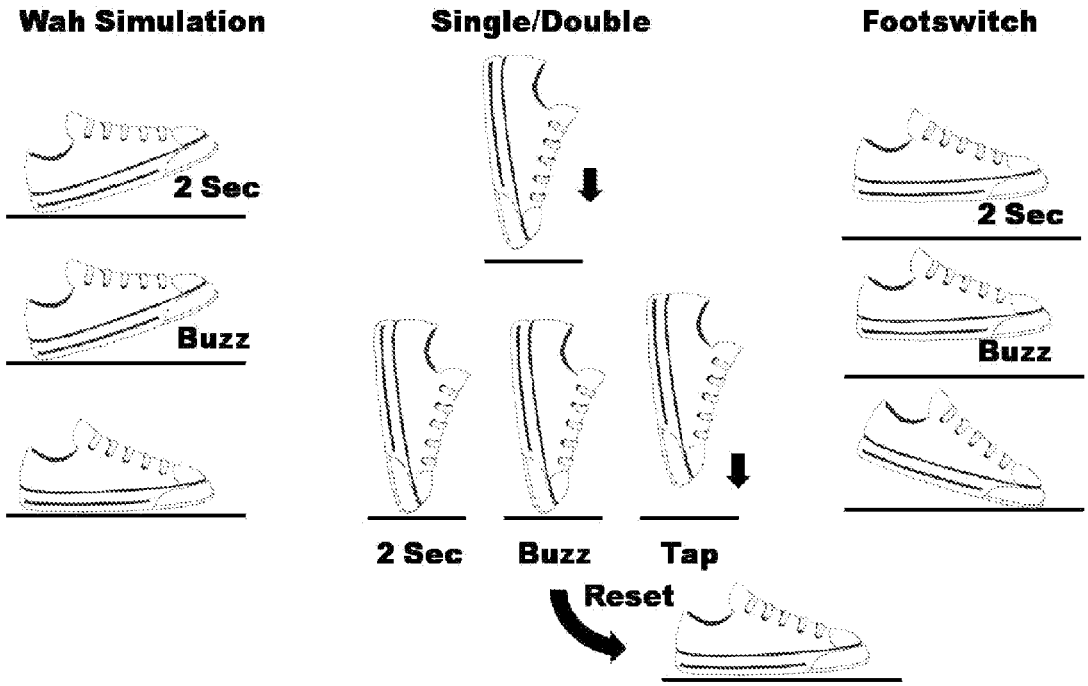
FIG. 11 shows a side view of various On/Off control methods.
Figure 12:
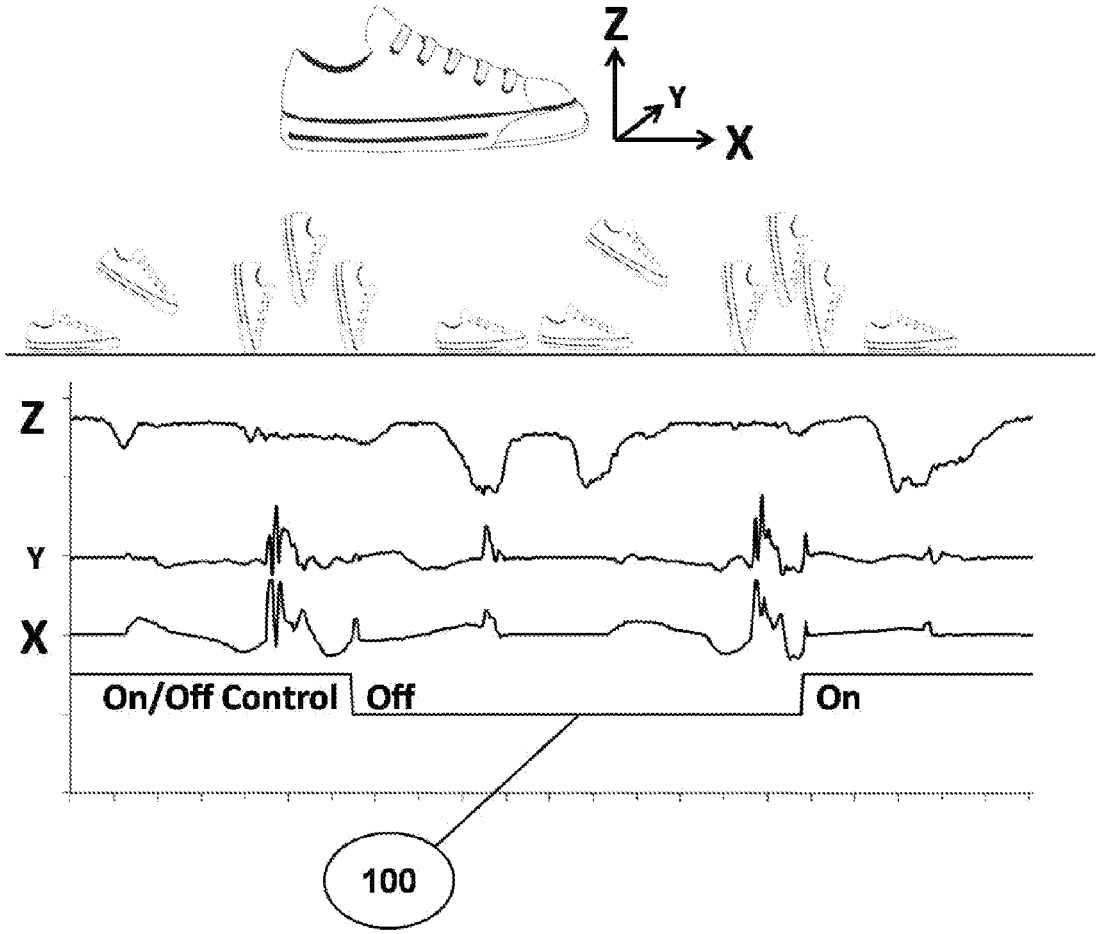
FIG. 12 shows accelerometer readings using a double toe tap method of On/Off control.
Figure 13:
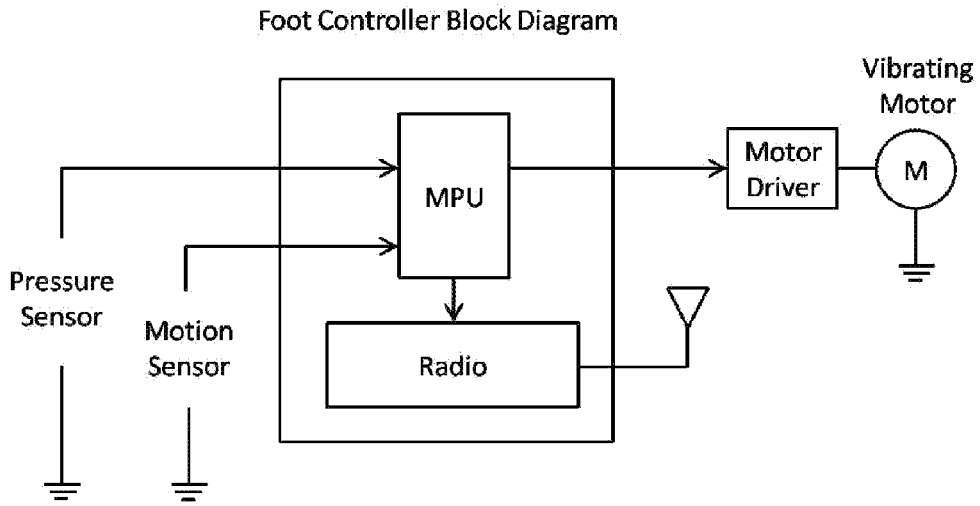
FIG. 13 shows a Functional Block Diagram of the Sole Transmitter.
Figure 14:
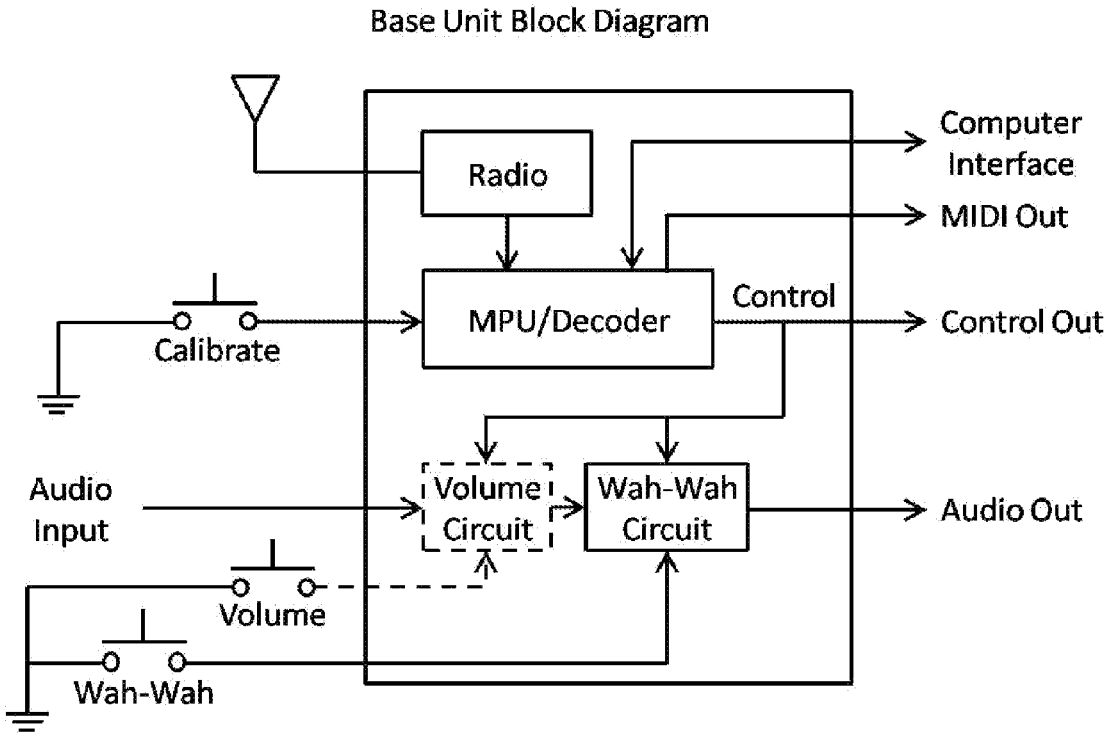
FIG. 14 shows a Basic Functional Block Diagram of the Base Unit.
Figure 15:
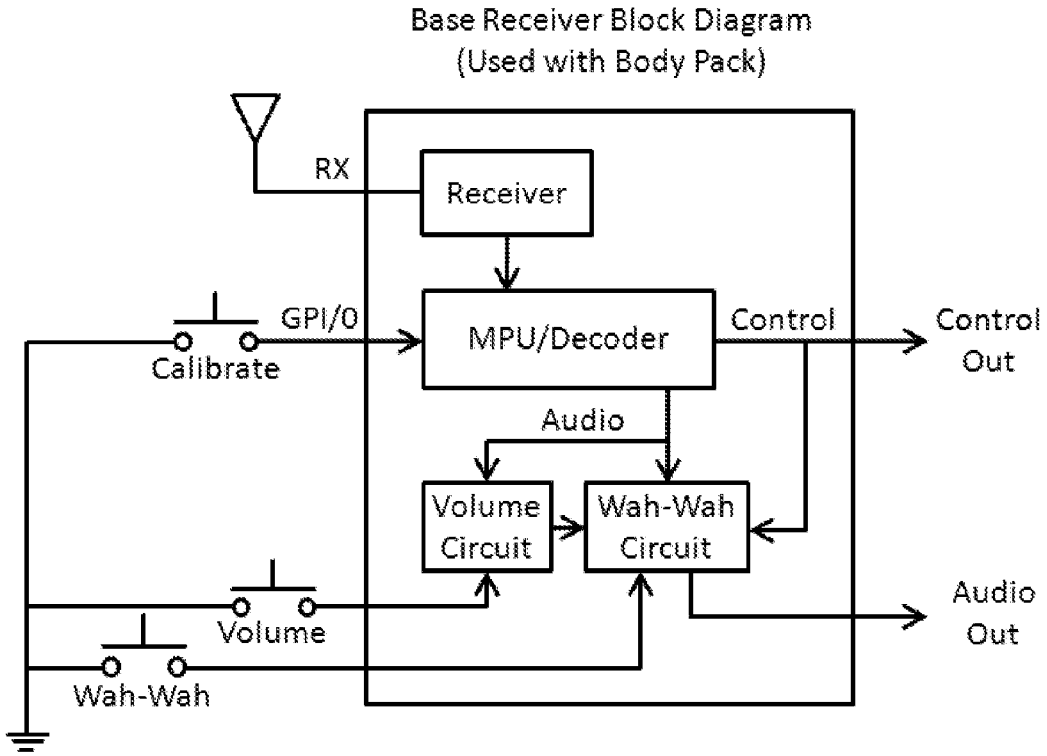
FIG. 15 shows a Basic Functional Block Diagram of the Base Unit when used with a Relay Body Pack.
Figure 16:
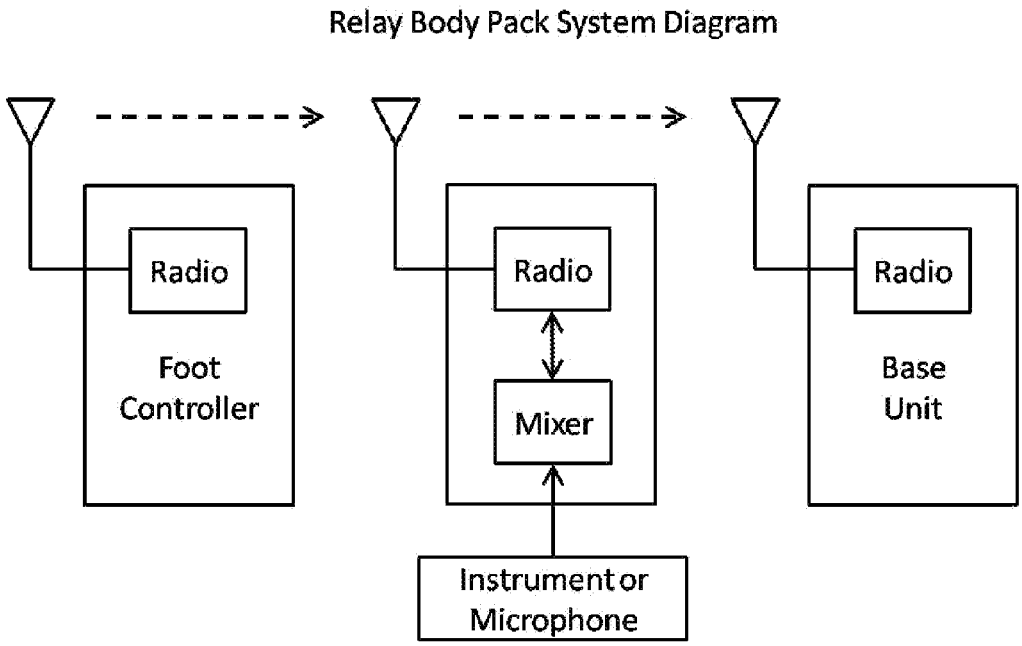
FIG. 16 shows the Relay Body Pack System diagram when used with an instrument or microphone that is plugged into the Relay Body Pack.
Figure 17:
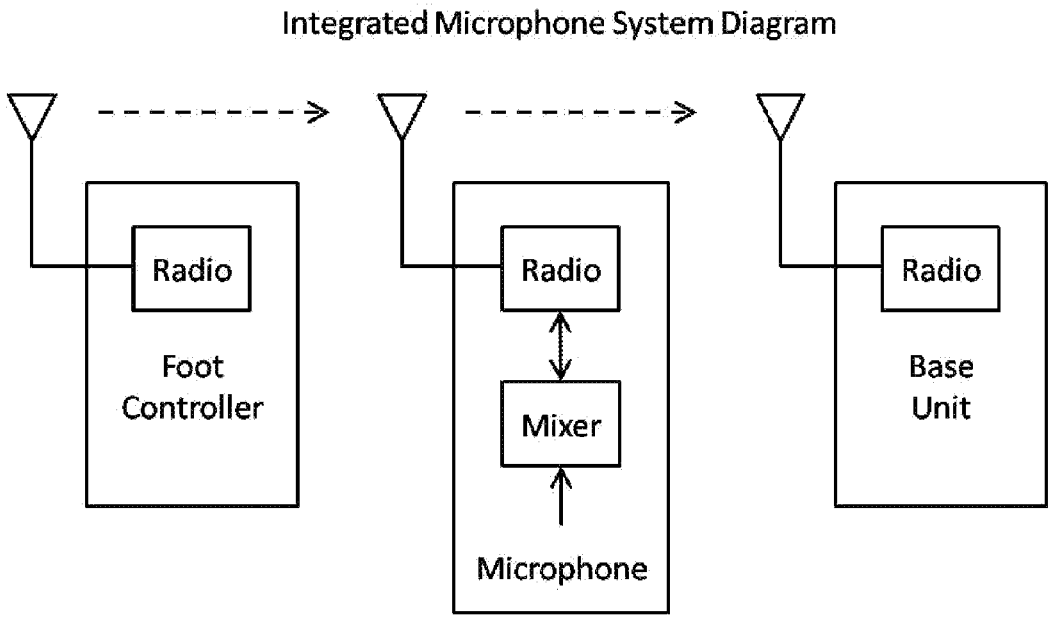
FIG. 17 shows Relay Body Pack System diagram when used with a wireless microphone.

Vibrator motor (6) of FIG. 1 is used to provide feedback to the user for the Control On/Off states, for example, one short burst for On, then two short bursts for Off. The vibrator (6) is also useful for more advanced process of On/Off control in order to reduce the risk of false triggers. FIG. 11 shows the XYZ accelerometer (5) readings resulting from a double toe tap of the footwear. On the second footwear tap, the control signal (100) toggles state. Data filtering such as averaging each axis of the accelerometer (5) generates smoother curves, and math transforms may be used for further curve analysis. Other patterns worth considering are shown in FIGS. 10 and 11. FIG. 11 also shows how the movement pattern is broken down into two stages. First position the toe pointing into the ground and hold this position for a period of time such as two seconds. After such time, the vibration motor (6) will pulse to indicate readiness. Then user has two options: Either executes the On/Off Control command with a single toe tap, or to simple lower the foot back onto the ground to exit the process without a control change. Variations of this process could include analysis of the pressure sensor to help with the intended outcome by the user.

Referring to FIG. 4, momentary push-button (25) is used to calibrate the sole assembly as needed to eliminate variables in the fitting of the sole within the shoe in addition to varied weight from one user to another. To calibrate, the user presses push-button (25) with the controlling shoe, then applies gradual pressure on the sole from minimum (foot in the air) to their maximum desired pressure, thus defining key parameters of the full range. LED (26) turns green to indicate a valid calibration in case the user performs a calibration either too quickly or if the user fails to complete the calibration procedure within a reasonable period of time. The Base Unit (20) software looks for a gradual increase in the control value from a minimum to a maximum which is the peak value received during the calibration period.

Figure 6:
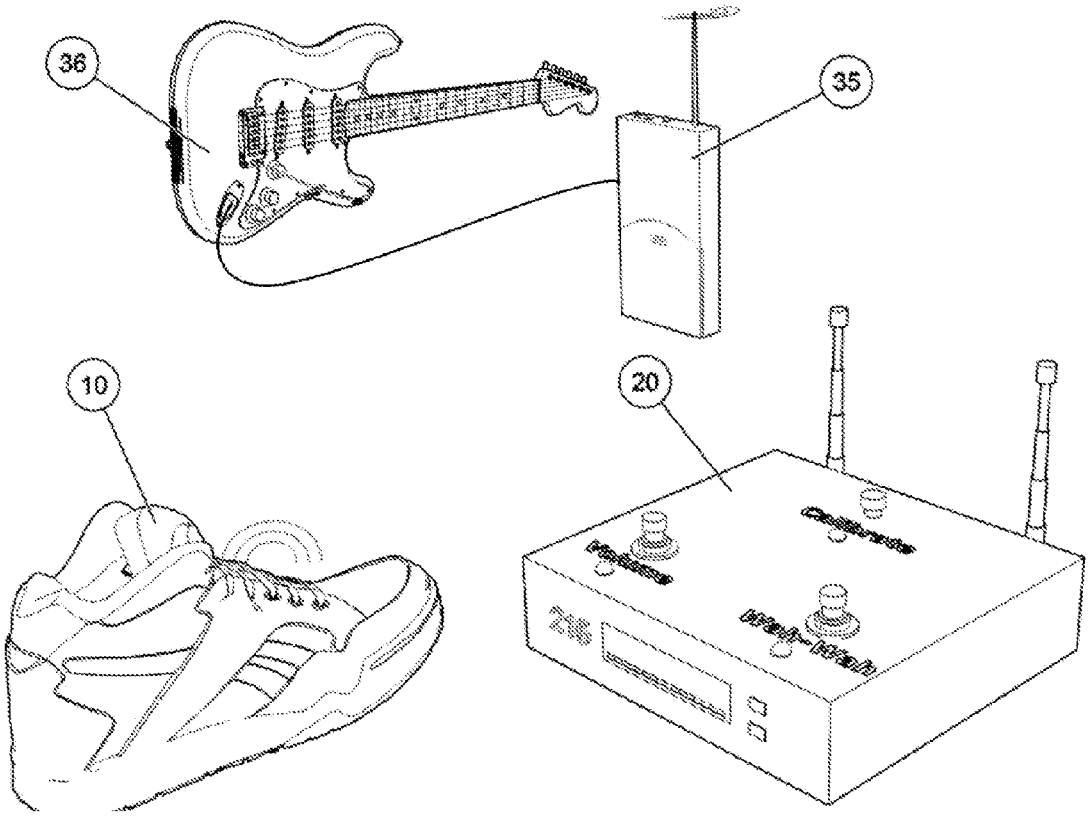
FIG. 6 shows the addition of a Relay Body Pack transceiver worn by the musician that receives the control signal from the foot controller and re-transmits this signal together with the audio signal to the Base Unit for decoding and modulation of the desired audio effect.

FIG. 6 shows the same basic system, only now integrated with a modified wireless audio transmitter or Relay Body Pack (35) attached either to the musician or their musical instrument. Like conventional wireless body packs, the musical instrument (36) is plugged into the Relay Body Pack (35) to transmit the audio signal. This new Relay Body Pack (35) design has a transceiver to act as a relaying device that forwards the control information from the sole on to the Base Unit. In this embodiment, the foot pressure signal is first received by the Relay Body Pack (35), and then digitally combined with the audio to be re-transmitted to the Base Unit. In a similar embodiment that uses the Relay Body Pack (35) method, basic audio effects could be contained within the Relay Body Pack (35) so that the resulting audio signal is already modulated before being sent to the final receiver (secondary receiver or Base Unit). This simplifies the secondary transmission, however the effect would need to be enabled or disabled on the Relay Body Pack (35) through convenient means because the Relay Body Pack (35) may not be easily accessible during a performance. Therefore, applying the effect within the Relay Body Pack (35) is not the preferred embodiment unless it is either fixed, easily accessible during a performance, or enabled remotely and wirelessly on or off-stage.

Figure 9:
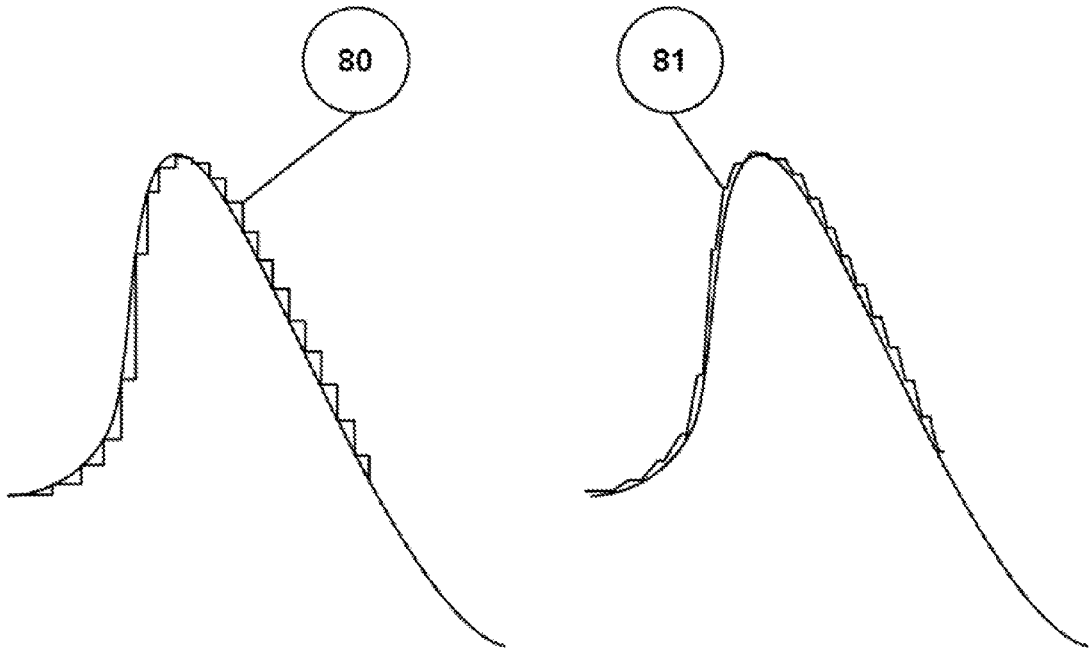
FIG. 9 shows the difference between the smooth input pressure control signal and output from the digital resistor before and after smoothing as a method to prevent unwanted zipper noise on the audio signal.

FIG. 9 shows the Base Unit Functional Block Diagram when using the Relay Body Pack (35) embodiment with only slight changes on how the audio is input to the system as compared to the more direct radio transmission without use of a Relay Body Pack (35). Here, the audio signal must first be decoded from the control signal using a reverse of the encoding schema. One proposed schema is to create a "message type" signature encoding and decoding format—one for audio and a separate one for sole pressure control. The final Base Unit receiver monitors the digital signal for either of these encoded signatures. Upon identifying this signature, the Base Unit would convert the content as either audio or sole pressure control before sending it on to its respective output. A preferred schema is to dedicate some of the bits (within each digital audio sample byte) for control only. Encoding would append these bits to each digital audio word before radio transmission, and then separate them during the decoding process to output their respective values. This schema could also be accomplished by using separate transmitters and receivers for audio verses control, but this would add to overall system cost and power usage. Therefore a combined appended signal is the preferred embodiment. Processing these signals on the Relay Body Pack (35) could add additional latency (delays) in the control signal until processors become faster, and we all know that will happen.

In yet another embodiment that uses the Relay Body Pack (35), it may be advantageous to use a low power sole transmitter and a Relay Body Pack (35) such that the Relay Body Pack (35) acts a as a radio repeater to amplify the control signal (without audio) to the Base Unit. This use case may be necessary for practical application to provide acceptable battery life of the sole transmitter for the basic system described earlier. This is included as an additional embodiment because there may be a potential market for a Relay Body Pack (35) system for those users already in possession of a wireless audio system and only wish to add this sole control capability to their existing gear, or if the practical performance of a direct radio transmission to the Base Unit is unacceptable in their stage and RF noise environment. It is further possible that the musician prefers cable-wired audio to the stage electronics or audio amplifier, and only wants to add the sole or foot control system to gain other audio effect control benefits offered by this invention. In this embodiment, the control signal would be processed on a simple, in-line device or Relay Body Pack (35) connection between the instrument and the cable that's connected to their pedal board or amplifier.

Figure 7:
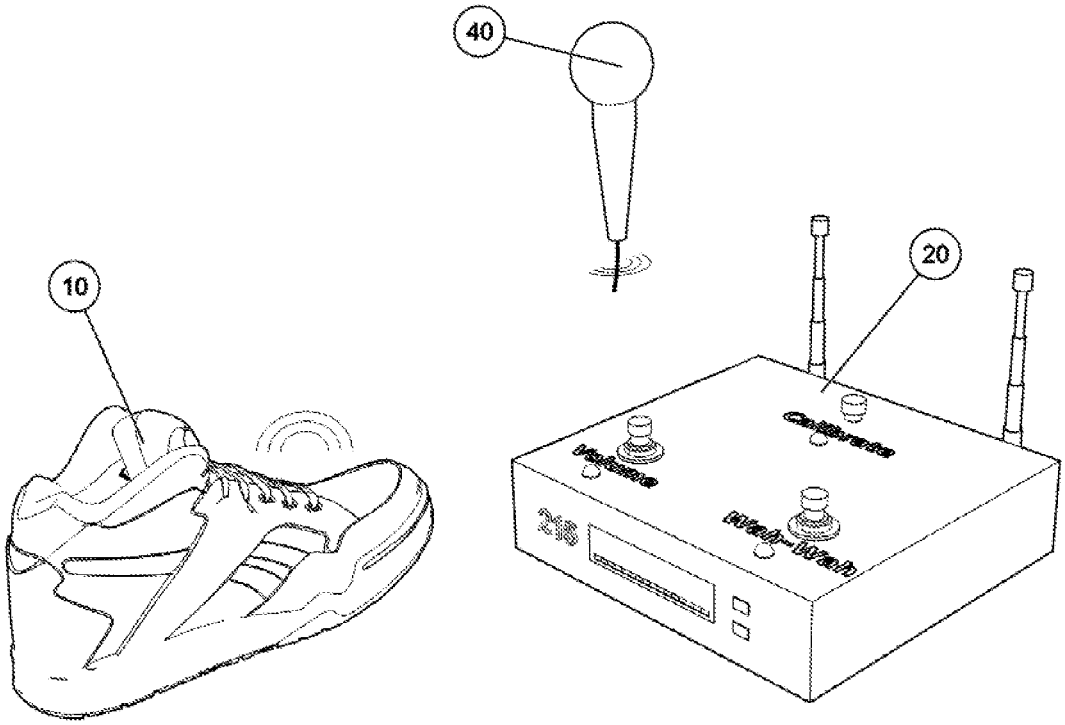
FIG. 7 shows a microphone that is used in the same manner as the Relay Body Pack for modulating audio such as voice or amplified instruments.

FIG. 7 shows another embodiment that is used to modulate audio effects for a wireless microphone (40). Conventional wireless microphones use two different radio systems, either with or without the use of a Wireless Pack to transmit audio. In either configuration, the control signal from the sole or foot is re-transmitted with the audio signal from the microphone using the same technology as the integrated Relay Body Pack (35) described earlier. This microphone embodiment provides a new wireless method of audio effect control such as volume, delay, pitch filter effects, or echo for singers, in addition to any number of audio effects when used to amplify musical instruments that are not electronic in nature.

Figure 8:
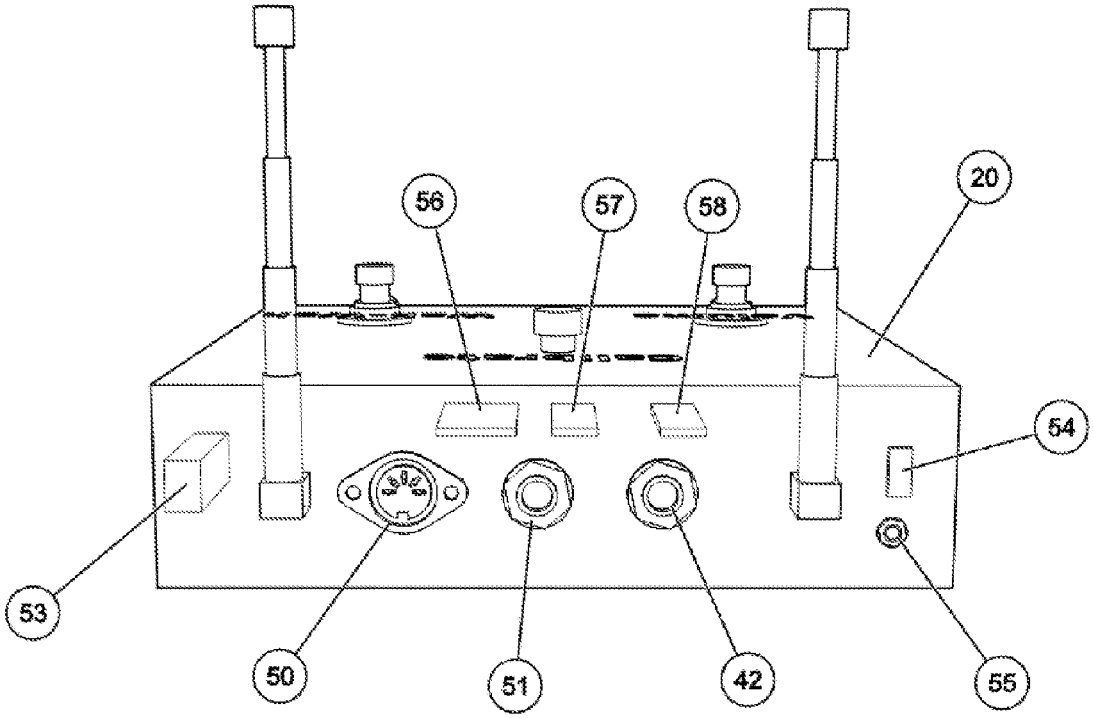
FIG. 8 shows typical connections on the back panel of the Base Unit.

FIG. 8 shows how this same control signal is used as an external "Control Out" signal (42) which is used to connect to other audio effects (30) and therefore is not limited to just the traditional Volume and Wah-Wah effects that are shown so far.

This control out signal can also be accomplished via a MIDI interface connector (50) to control other sounds as desired. When configured by software, the pressure sensor can be configured to act as trigger for generating MIDI commands to provide the ability to generate instrument sounds such as a drum beat or the many MIDI voices commonly available. Other connections in FIG. 8 include a Resistor Out (51) stereo phono connection or similar that has the same electrical characteristics as an Effects Controller Pedal available today. A communication port such as USB connector (54) offers a computer interface for downloading upgraded firmware through the microprocessor (56).

Figure 5:
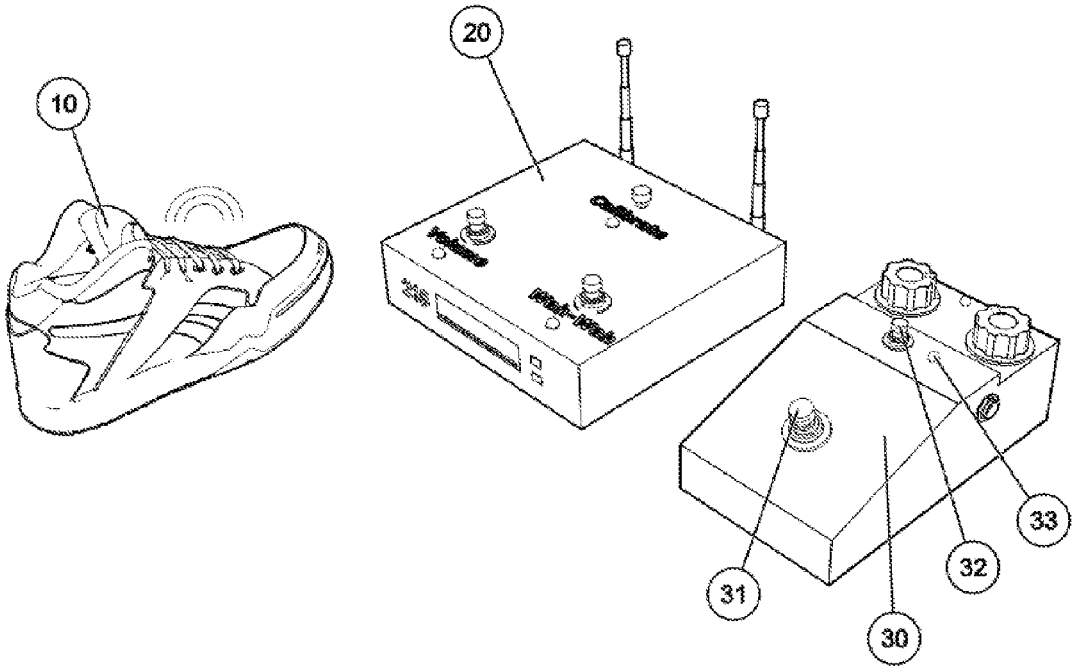
FIG. 5 shows an external audio effect box that is also controlled by the foot controller.

In another embodiment, FIG. 5 shows a separate audio effect box (30) with the traditional on/off switch (31) for engaging the effect. Switch (32) is added to this device for assigning control of the On/Off control signal to that particular audio effect. LED (33) is used to indicate when control is assigned to that effect. A simple wire cable using a simple control analog or digital signal connects several external effects from connector (42) on the Base Unit in a daisy chain configuration to transmit the control signal from the Base Unit to all audio effects capable of accepting this control signal input. Each audio effect box that employs this technology would have unique parameters that would be modulated depending upon the type of effect it generates. Furthermore, an additional multi-pole switch on the audio effect is used to assign this incoming control signal to one of the various audio effect parameters to be modulated as it makes sense for that particular audio effect. For example, a musician may wish to modulate either delay time or delay decay amount for a given delay audio effect box. The control signal in this manner could be used to modulate either of these parameters as set by the musician.

A similar embodiment allows for input of the wired control signal into a multi-effect console where it is optionally applied to the desired effect or effects in the same manner described earlier or through the use of a menu system.

In yet another similar embodiment, all Base Unit electronics could be integrated within a multi-effects console to be assigned or activated by either a footswitch or remotely by foot controller activation methods from the idle state as described earlier. In addition, an optional multi-pole switch or a software menu system could include specific assignment of the sole control and further be assigned as a custom composite mix of audio effects in the system's memory for quick stage access. With all of these multi-effect console options described, this embodiment simply adds the foot controller capability of this invention to existing console type systems and features that already exist through either remote wire control or integration of the Base Unit as one compact unit, either on the stage floor, rack, or offstage.

Another embodiment considers the overall design of the footwear such that comfort is not compromised in any way. By making use of the heel space, toe space, the shoe covering, or any other areas of the shoe, boot or sandal, the overall design could be made permanent with the added potential for replaceable components (for example a heel section containing a majority of the electronics that is reused when the shoe is worn). For the sole insert or other embodiments, wear components of the assembly such as the encasement, sensor, electronics module, motor, or battery could all be designed for either user or field replacement by the user or a qualified technician so as to greatly extend the life of the product.

In preliminary testing when using the foot controller as described in this invention to generate MIDI commands for generating a sound, it became apparent that consistent shaking type control is difficult when using the feet. Further, attempts to use peak acceleration (for example, at the instant of contact of the heel with the floor) on only alternate up/down cyclic motions of the heel (to allow for reproduction of the sound produced when the tambourine is hit against the other hand) proved difficult to physically coordinate consistently with the foot. As a result, an improved method of sensing this motion is to mount the electronics (radio, battery, MPU, and accelerometer) inside a ball as a hand held device. This would more closely resemble use of the instrument when shaken with the hand instead of the foot. The other advantage of using a ball is lower cost as compared to footwear. Additional mass of the ball (through the use of heavier materials such as hard rubber or fillers within the molded product, or by making it larger) could allow for even more control for the desired act of shaking in a smooth and regular cyclic motion.

By considering the fact the this invention is actually a pedal that is with the user at all times, this invention can also be applied to other fields, industries, games, or even sports. The key criteria in identifying suitable application are as follows: 1) A pedal that is difficult to locate because of darkness or other environments that make it difficult to locate, 2) A pedal that needs to be used without taking your eyes off the task at hand, 3) A pedal that needs to be used even if the user moves their feet from location to location, 4) A controllable output or sensing that lends itself more to the feet than other conventional controls (such as a gas or brake pedal), 5) A pedal that requires fast monitoring of motion by the user (safety response). Other fundamental criteria could exist, but these are the critical factors used to decide useful application of a foot controller. Another example that satisfies criteria #3 could be used by a surfer such that the pressure on the foot or toe area (no matter where the foot is located on the surfboard) could wirelessly control the rudder (and degree of steering capability) for added control and sharper turns as needed—this same control system could help stabilize the board for a student surfer by turning the rudder toward the unbalanced direction left or right.

With any of the embodiments described herein, analog radio systems could be employed in place of digital. However analog systems are inferior in both reception quality and would likely require added radios within the Relay Body Pack (35) and the Base Unit (20) for integrated systems because of this technology's inability to encode the separate audio signal and the control signal into a single AM transmission. Therefore, digital transmission would be the preferred embodiment. Also, it is assumed that all of these systems use FM type radio modulation as opposed to AM, however, it is possible to achieve similar but lower quality results when using AM. Therefore, FM is the preferred method for all embodiments described in this patent.

These methods of audio effect control, all based on foot pressure and motion, virtually eliminate the need for any pedal type controllers and therefore simplifies the overall system with increased portability. It reduces the amount of gear and space required on stage, and allows for control of multiple effects as selected by the performer which, until now, have not been possible when using independent boxes for each audio effect. Finally, this invention provides the added freedom for the performer to move about the stage while modulating a given audio effect or effects; this introduces a new capability for the performer by integrating their movements with various audio effects as compared to standing still at a fixed location while pressing a pedal.

Consider the following as one out of many possible examples where the overall performance is enhanced. Imagine an audio effect that controls the musician's audio volume from the left side of the stage to the right. The performer could control this left/right panning effect with the sole of the shoe by shifting their weight back and forth while singing or playing an instrument, and all the while keeping the effect in complete sync with the audio rhythm that they produce. Even a professional sound Engineer off-stage would not be able to control the panning as well as the performer themselves. Another audio effect such as an echo delay could respond to the performer's jumping or even running action. In these scenario, as well as numerous others, the combined motion of the performer, when synchronize with the audio, results in a greater stage performance and presence that audiences demand.

As an example of a more versatile embodiment, the foot controller system could be incorporated into a gaming system such as Guitar Hero™ to further simulate the rock star. Training could also be implemented for teaching the use of audio effects when played with musical instruments.

What is claimed is:

1. An audio effects controller, comprising a foot controller comprising a first microprocessor and a pressure sensor configured to monitor foot pressure and transmit at least one control signal in response to detecting sensed foot pressure, the foot controller further comprises a motion detection device that detects a foot movement pattern and at least one of the first microprocessor or the second microprocessor is further configured to compare the foot movement pattern to a preset foot movement pattern to enable or disable the at least one audio effect; and a base unit comprising a second microprocessor and configured to receive the at least one control signal to activate, deactivate, or modulate one or more audio effects on an audio signal in response to the control signal.

2. The audio effects controller of claim 1, wherein the motion detection device comprises an accelerometer or a gyroscope.

3. The audio effects controller of claim 2, wherein the pressure sensor comprises a force sensing resistor, a MEMS device measuring strain or pressure, a pressure compressive variable resistive material, or an electro-mechanical device configured to measure pressure.

4. The audio effects controller of claim 1, wherein the base unit further comprises a digital potentiometer, and wherein resistance of the digital potentiometer is controlled by the control signal and is used to vary volume, wah-wah, other audio effects, a software program to generate MIDI commands, or resistance out to the one or more audio effects as an expression pedal.

5. The audio effects controller of claim 1, wherein the control signals are integrated with a video gaming system or training system to monitor the foot controller signals or to provide tactile feedback for the user.

6. The audio effects controller of claim 1, further comprising a relay device that communicates wirelessly between the foot controller and the base unit, and further accepts a source audio signal from a musical instrument or a microphone that is also wirelessly transmitted to the base unit.

7. The audio effects controller of claim 1, wherein the base unit is configured to activate, deactivate, or modulate specific audio effects of the one or more audio effects.

8. The audio effects controller of claim 1, further comprising an electro-mechanical device such as a reed relay in the base unit or externally controlled audio effects, that enables or disables the at least one audio effect and allows for True Bypass of audio effects electronics when the audio effects electronics are not in use.

9. An audio effects controller, comprising:

a base unit;

at least one microprocessor;

a foot controller configured to communicate with the base unit and comprising:

a motion detection device that detects at least one foot movement pattern, wherein at least one audio effect on an audio signal is enabled when the at least one foot movement pattern matches a preset audio effect enablement pattern stored in the at least one microprocessor, and at least one audio effect is disabled when the at least one foot movement pattern matches a preset audio effect disablement pattern stored in the microprocessor; and a pressure sensor configured to monitor foot pressure, wherein a control signal is produced by the pressure sensor in response to detecting pressure when the at least one audio effect is enabled and transmitted to the base unit for activation, deactivation, or modulation of the at least one audio effects on the audio signal.

10. The audio effects controller of claim 9, wherein the motion detection device comprises an accelerometer or a gyroscope, and the pressure sensor comprises a force sensing resistor, pressure compressive variable resistive material, a MEMS device for measuring pressure of strain, or an electromechanical device configured to measure pressure.

11. The audio effects controller of claim 9, further comprising a tactile signal element configured to produce a tactile signal when the one or more audio effects on the audio signal is enabled or disabled.

12. The audio effects controller of claim 9, wherein the base unit further comprises a wahwah effect, a volume effect, a varied resistance output, or a MIDI output that is controlled as a function of foot pressure on the pressure sensor.

13. The audio effects controller of claim 9, wherein the pressure sensor and the motion detection device detect the at least one foot movement pattern.

14. A method for controlling audio effects, comprising:

detecting at least one foot movement pattern with a motion detection device on a foot controller;

comparing the at least one foot movement pattern to preset audio effect patterns;

enabling at least one audio effect when the at least one foot movement pattern matches a preset audio effect enablement pattern;

disabling the at least one audio effect when the at least one foot movement pattern matches a preset audio effect disablement pattern;

detecting foot pressure with a pressure sensor on the foot controller;

producing a control signal in response to detecting the foot pressure when the at least one audio effect is enabled;

transmitting the control signal from the foot controller to a base unit; and activating, deactivating, or modulating the at least one audio effect on an audio signal with the base unit or through the base unit to other audio effects.

15. The method of claim 14, further comprising producing a tactile signal with a tactile signal element when the one or more audio effects on the audio signal is ready, enabled, or disabled.

16. The method of claim 14, further comprising modulating as a function of foot pressure the wah-wah effect, the volume effect, resistance or control out to other audio effects, or the MIDI out.

17. The method of claim 14, further comprising eliminating a zipper effect with software that creates incremental or decremental digital potentiometer steps between pressure samples taken from the pressure sensor.

18. The method of claim 14, further comprising calibrating the motion detection device or the pressure sensor.

19. The method of claim 14, further comprising arming or disarming the control signal to allow selection of which audio effect of the at least one audio effect is capable of being controlled by the control signal.

* * * * *